US005154420A

United States Patent [19]

Gutknecht

[11] Patent Number: 5,154,420

[45] Date of Patent: Oct. 13, 1992

[54] GAME APPARATUS

[76] Inventor: Leroy H. Gutknecht, 5673 Annie Oakley, Las Vegas, Nev. 89120

[21] Appl. No.: 806,371

[22] Filed: Dec. 13, 1991

[51] Int. Cl.[5] ..... A63F 9/00

[52] U.S. Cl. ..... 273/138 A

[58] Field of Search ..... 273/138 A, 142 HA, 142 H, 273/143 R

[56] References Cited

U.S. PATENT DOCUMENTS 2,095,367 10/1937 Mattson ..... 273/192 HA
3,633,916 1/1972 Thomas ..... 273/142 HA
3,817,532 6/1974 Lee ..... 273/142 HA

FOREIGN PATENT DOCUMENTS 2105891 3/1983 United Kingdom ..... 273/142 H

*Primary Examiner*—Benjamin H. Layno
*Attorney, Agent, or Firm*—Jack C. Munro

[57] ABSTRACT

A game apparatus which utilizes a representation of a coin with this coin being divided into a central member and an outer member with this central member being centrally mounted within the outer member. Both the central member and the outer member are capable of being revolved on separate revolving axes. The revolving is initiated substantially simultaneously and is stopped simultaneously with the result that the coin can assume any one of four positions, a heads, a tails, a head-tails and a tails-heads. The player is to guess at what position the coin will assume after revolving of the inner member and the outer member and, if the player is correct, a certain pre-established payout arrangement will be granted to the player.

7 Claims, 5 Drawing Sheets

GAME APPARATUS

BACKGROUND OF THE INVENTION

1) Field of the Invention

The field of this invention relates to gaming apparatuses and more particularly to a gaming apparatus which is designed to be used in conjunction with gambling.

2) Description of Prior Art

Gambling is an exceedingly common form of entertainment to a great number of people. Well known gambling areas within the United States are Las Vegas, Nev. and Atlantic City, N.J. Players tend to like games that provide a chance of "winning big", exciting to play, simple to play, utilize a reasonable amount of thinking ability and have a high payout ratio. For the casino, desireable games are games that are fast so that the game can be played repeatedly in a very short period of time with each play only taking a matter of a few seconds.

Casinos long have utilized machines to be operated by the players themselves obviating the need for dealers. An exceedingly common form of such machines are referred to as "slot machines". Slot machines do not require the need of a dealer and permit the player to play at his or her pace at the particular machine.

It used to be that slot machines utilized only a plurality of rotating tumblers with indicia such as cherries, lemons, oranges and other fruit being represented on the tumblers. When the same type of fruit is in alignment at a horizontal or diagonal line, the slot machine pays of a winning amount.

Within recent years, the concept of the slot machine has been expanded to be utilized with other types of games. For example, machines have been utilized to play blackjack and poker. Such machines have proved to be readily accepted since the blackjack and poker can be played at wagering levels substantially less than what would be required at a table for such a game where a dealer is utilized.

SUMMARY OF THE INVENTION

The primary objective of the present invention is to construct a slot machine type of game which utilizes a different concept than rotating tumblers which is commonly used in conjunction with such machines.

Another objective of the present invention is to produce a game which is simple to play by both the player and the casino, fast to play and exciting to play.

Another objective of the present invention is to construct a gaming device that can be played quickly thereby permitting a substantially great number of plays that can be played within a rather short period of time.

Another objective of the present invention is to provide a gaming device that is fast, exciting, entertaining, simple to play, challenging, has a potentially high payout level and a potentially high top end award.

The game of the present invention utilizes a housing with the housing including a coin insert slot and a start button. Activation of the start button initiates random motion of the machine which revolves in opposite directions a central member of a coin representation relative to a ring shaped outer member which also forms in part the representation of the coin. The revolving motion of the coin can be stopped in any one of four positions. Each position is represented by a separate button mounted on the exterior of the housing. Upon the player pressing one of those buttons for a particular indicia representation and the coin displays that position, the player will receive a payout according to a predetermined payout schedule.

DETAILED DESCRIPTION OF THE SHOWN EMBODIMENT

Figure 1:
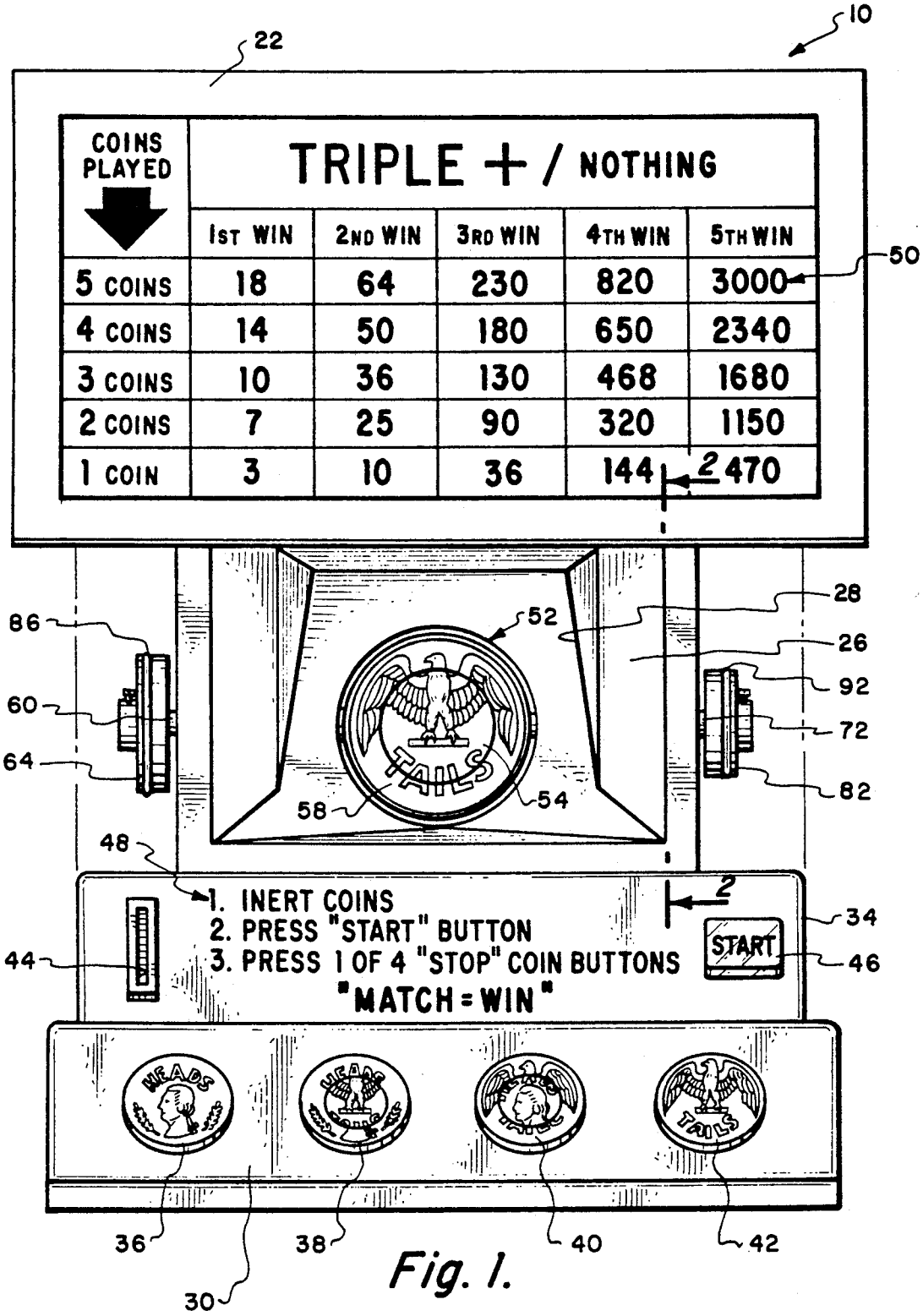
FIG. 1 is a front view of the game apparatus of the present invention.
Figure 2:
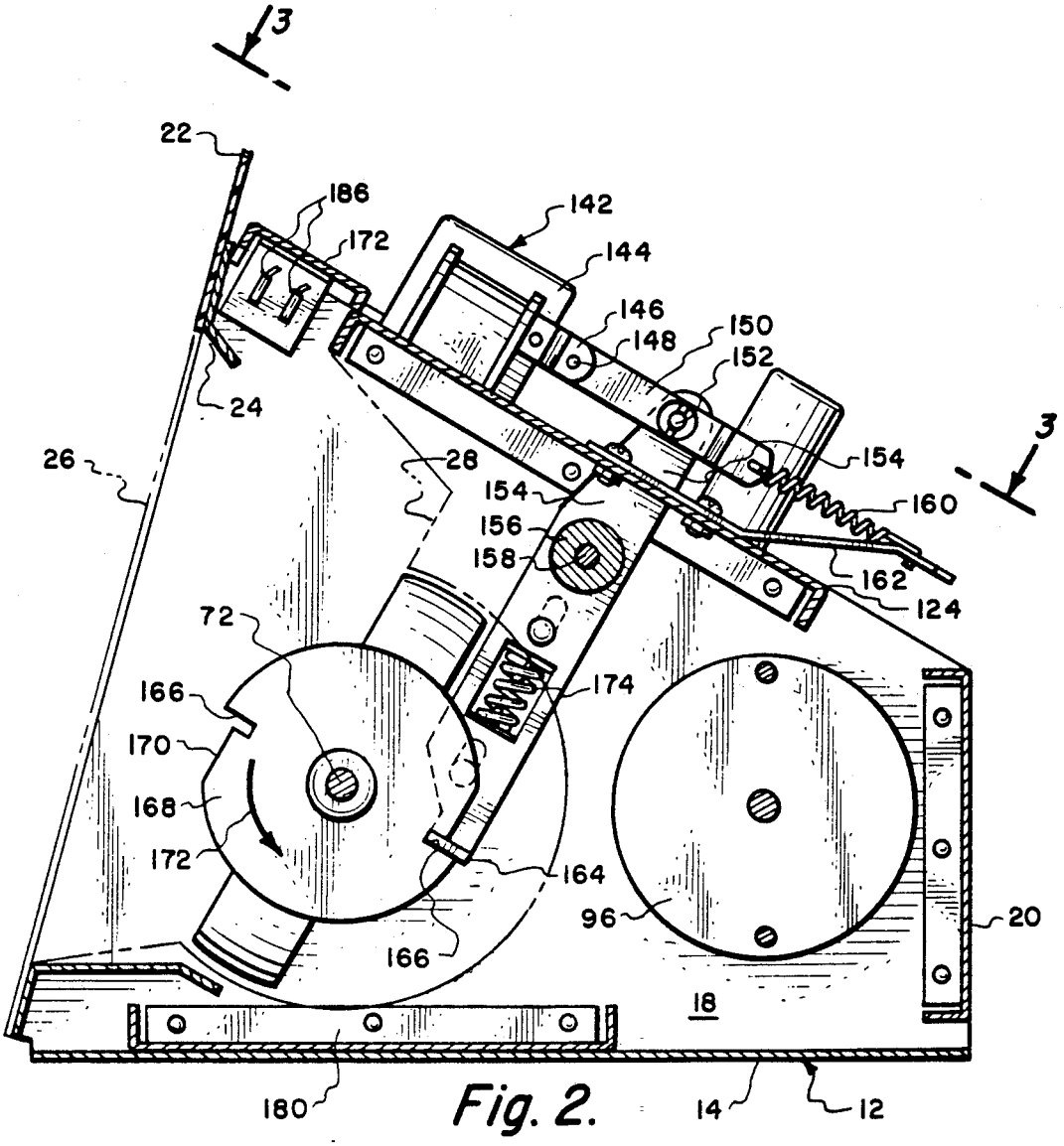
FIG. 2 is a cross-sectional view of the game apparatus of the present invention taken along line 2—2 of FIG. 1 showing the revolving stopping structure for the central member of the coin representation included within the gaming apparatus of the present invention.

Referring particularly to the drawings, there is shown in FIG. 1 the exterior front panel of the gaming apparatus 10 of this invention. Gaming apparatus 10 includes a sheet material, normally metallic, housing 12 which is composed of a bottom panel 14 to which is attached and extending upwardly therefrom a right side panel 16, a left side panel 18 and a back panel 20. The front panel is composed of a display sign 22 which is fixedly mounted on front cross brace 24 which is mounted between the side panels 16 and 18. The front panel also includes recessed center panel 26 which has an enlarged recess 28. The front panel also includes an inclined base 30 which is to be located against a supporting surface 32 such as a table. Attached to the upper edge of the inclined base 30 is a main panel 34. The recessed center panel 26 rests against the upper edge of the main panel 34.

Mounted within the inclined base 30 are a series of actuating buttons 36, 38, 40 and 42. Each of the buttons 36 to 42 are individually pressable. Button 36 has indicia on its outer surface resembling the head of a coin. Button 42 has indicia on its outer surface resembling the tail of a coin. Button 38 has indicia on its outer surface resembling a combination of heads and tails, while button 40 has indicia on its outer surface resembling the combination of tails and heads.

Within the main panel 34 is located a coin slot 44. A pressable start button 46 is also mounted in the main panel 34. Imprinted on the main panel 34 are a series of instructions 48.

The display sign 22 displays a payout schedule 50. This payout schedule 50 is to represent to the player of the game the number of coins that can be won upon achieving a win for each coin played and what can be won if repetitive wins are obtained.

Suspended within the enlarged recess 28 is a representation of a coin 52. This coin 52 is composed of a central (inner) member 54 which is basically in the configuration of a disc. The central member 54 is located within a circular shaped opening 56 which is centrally located within an outer member 58. The outer member 58 is basically ring shaped. Connected to the outer member 58 is a shaft 60. Shaft 60 is mounted by ball bearing assembly 62 within left side wall 18. The outer end of shaft 60 has fixedly mounted thereon a pulley 64.

Shaft 60 is fixedly secured to outer member 58 by means of a pin 66. The end of shaft 60 includes a recess 68 within which is mounted a bearing assembly 70. Mounted within the bearing assembly 70 is an outer end of a shaft 72. The shaft 72 is to be freely rotatable by bearing assembly 70 relative to shaft 60. Shaft 72 has an axis 74 of rotation which coincides with the axis 76 axis of rotation of shaft 60.

Shaft 72 is fixedly mounted by pin 78 to central member 54. Shaft 72 is supportingly mounted by bearing assembly 80 within the right side panel 16. Fixedly mounted on the outer end of the shaft 72 is a pulley 82. Shaft 72 is also conducted through the outer member 58 and is low frictionally supported thereto by means of a bearing 84.

Belt 86 connects pulley 64 to a drive pulley 88. Drive pulley 88 is rotated by means of a motor mounted within motor housing 90. Belt 92 is mounted on pulley 82 and is also connected to a drive pulley 94. Drive pulley 94 is rotated by means of a motor (not shown) mounted within motor housing 96. Motors contained within motor housing 90 and 96 are to be simultaneously actuated when button 46 is pressed. This in turn causes shaft 60 to be driven in one direction and shaft 72 to be driven in the opposite direction. It is to be noticed that pulley 82 is of a lesser diameter than pulley 64. This will cause the central member 54 to be revolved not only in the reverse direction relative to outer member 58, but also at a different speed and actually at a faster speed. This is desireable since human beings, who would be playing the game, can become quite good at calculating exactly when a certain heads-tails combination might be displayed. Therefore, the fact that central member 54 revolves at a much faster rate than outer member 58, it becomes almost impossible for a human being to make a precise guess as to what combination will be displayed.

The coin 52 is basically in the shape of a large size currency coin. These coins are known to have configurations on each side and it is common for one configuration to be termed heads and the other configuration to be termed tails. Probably the heads comes from the representation on the front side of the coin of the head of a human being and tails probably comes from logically then saying that the opposite side of the coin would be tails.

Figure 7C:
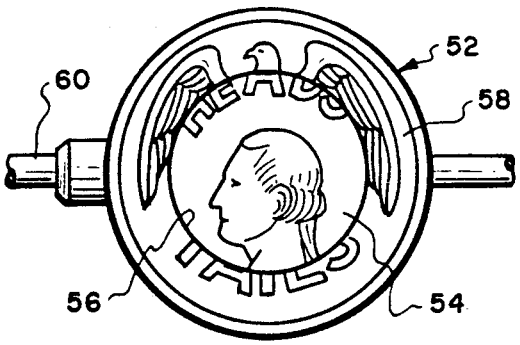
Figure 7D:
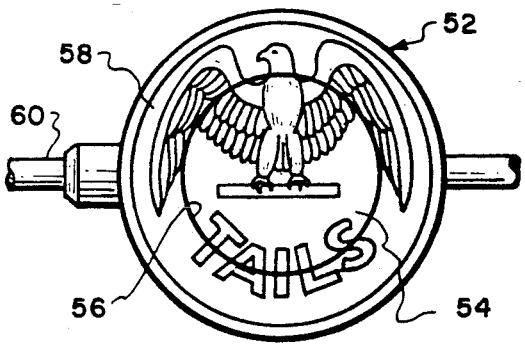
Figure 3:
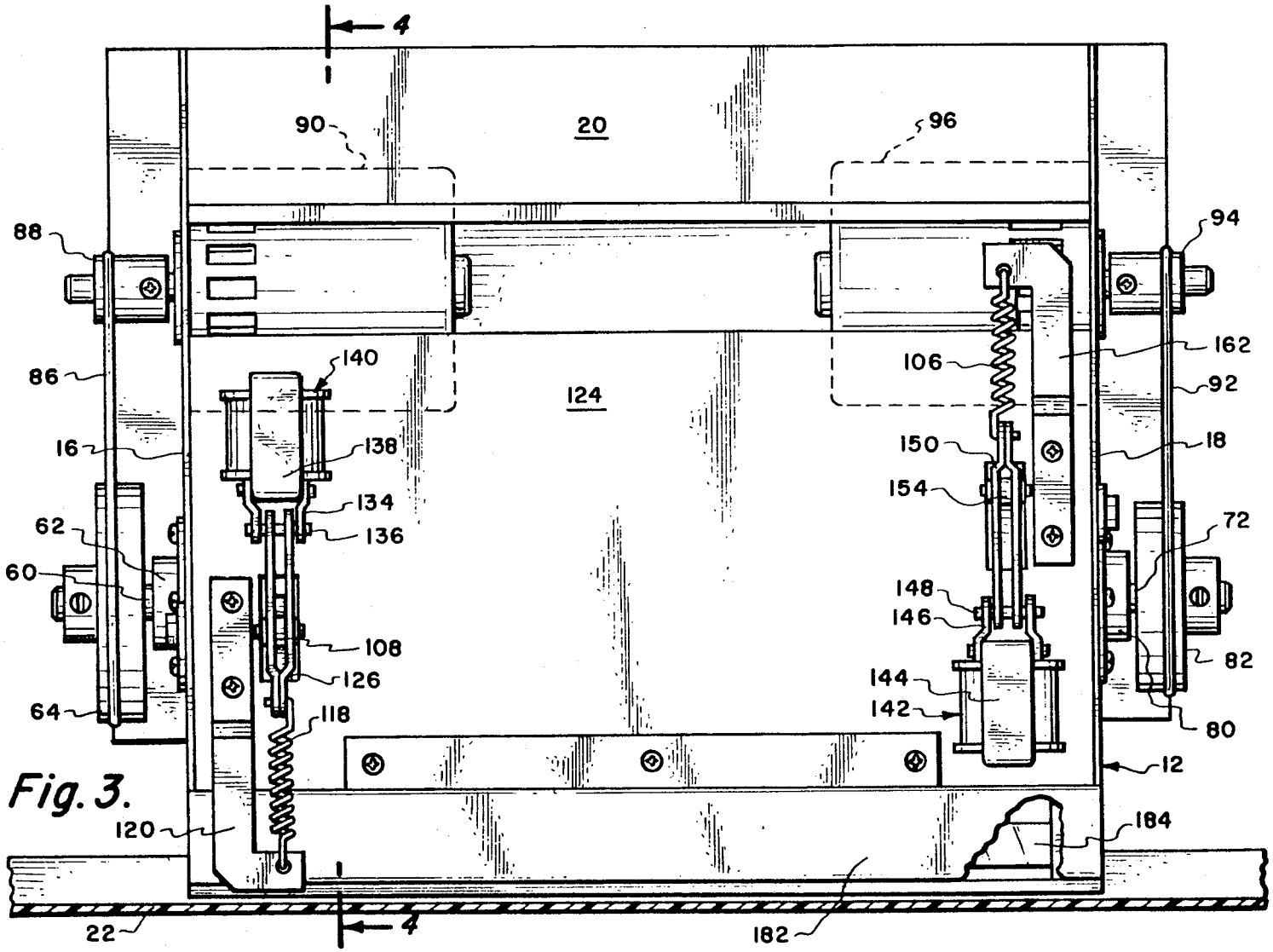
FIG. 3 is a top view of the gaming apparatus of the present invention taken along line 3—3 of FIG. 2.
Figure 7A:
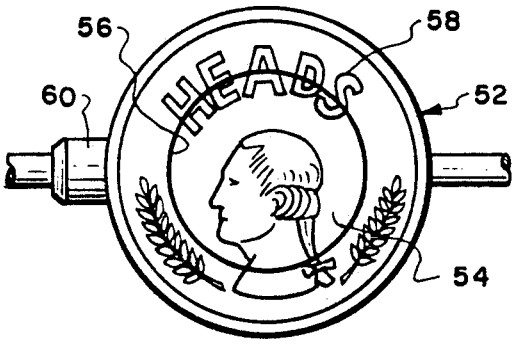
Figure 7B:
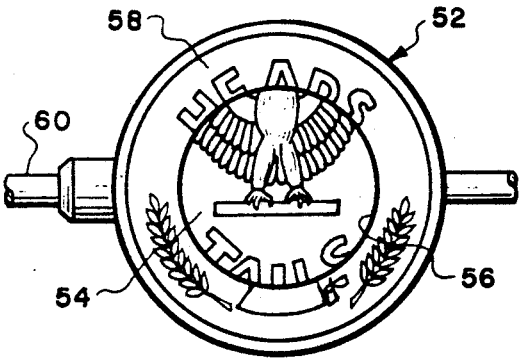
Figures 5, 6:
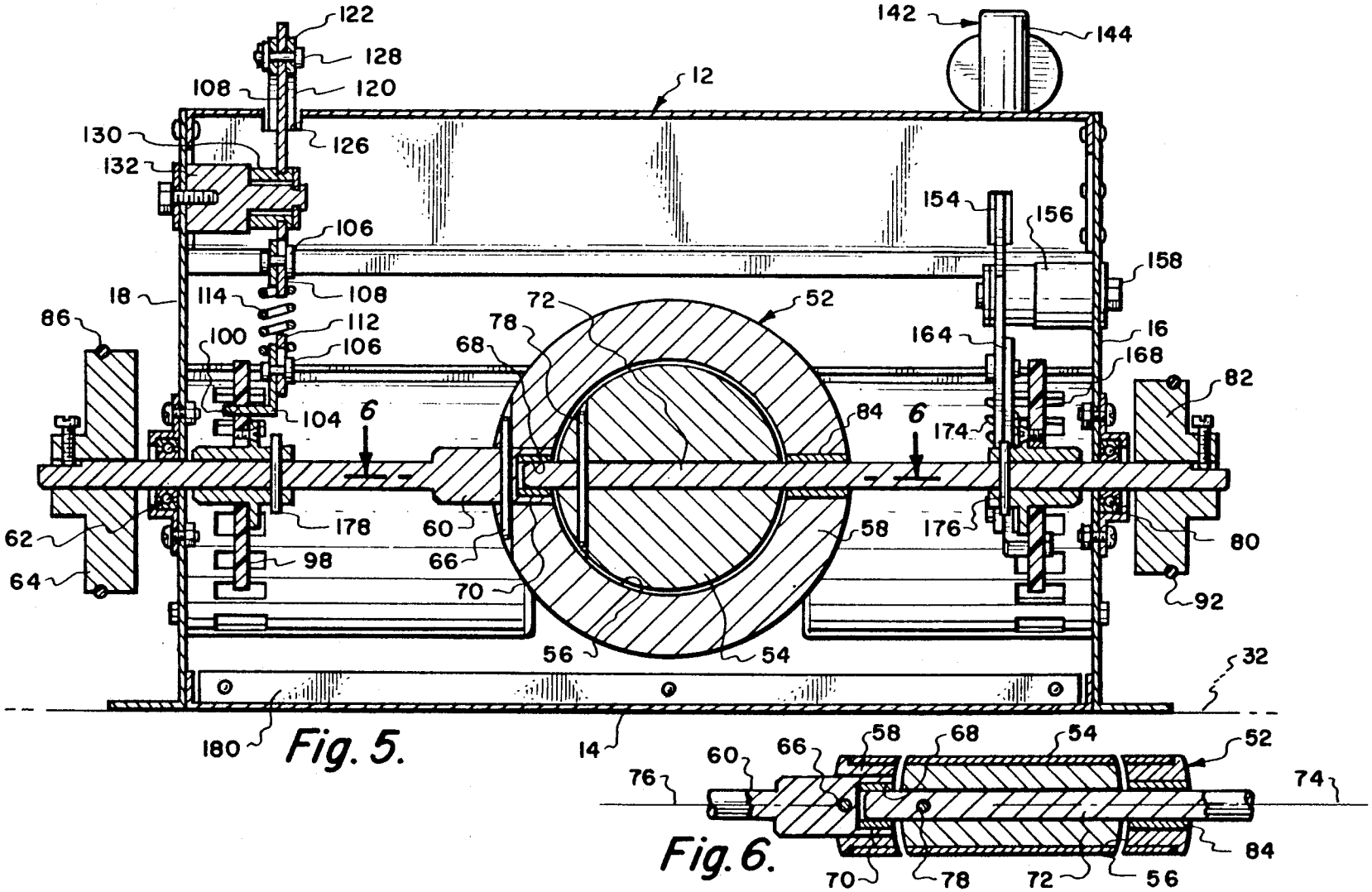
FIG. 5 is a cross-sectional view taken along line 5—5 of FIG. 4 showing clearly the structural arrangement between the central member and the outer member of the coin representation.
FIG. 6 is a cross-sectional view taken along 6—6 of FIG. 5 showing further details of the structural arrangement between the central member and the outer member of the coin representation; and FIGS. *7a* through *7d* depict the different indicias for the coin representation utilized in conjunction with the gaming apparatus of this invention.

Referring particularly to FIG. 7*a*, there is shown the front side of the coin with the word heads and the head of a human being along with a couple of olive branches. Referring particularly to FIG. 7*d* there is depicted the tail side of the coin with the word tails and an eagle shown on a perch. Besides the heads and tails configurations that can be obtained, the position of the outer member 58 could be in the heads position with the central member 54 being in the tails position as shown in FIG. 7*b*. Also, the outer member 58 could be in the tails configuration with the central member 54 in the heads configuration. Therefore, there are four possibilities and only those four possibilities obtained when operating the gaming apparatus 10 of this invention.

When the central member 54 and the outer member 58 are revolved relative to each other, and the operator pushes either button 36, 38, 40 or 42, the operation of the gaming apparatus 10 will be deactivated and the central member 54 and the outer member 58 will be stopped. When being stopped, it is important that the central member 54 precisely display either a heads or tails and also the outer member 58 precisely display either heads or tails. In order to achieve this precise displaying, a mechanism is required which will now be explained.

Fixedly mounted on shaft 60 in between the outer member 58 and the bearing assembly 62 is a wheel 98. Wheel 98 includes a pair of slots 100, these slots 100 being located one hundred eighty degrees (diametrically spaced) apart relative to the shaft 60. Associated with each slot 100 is an indented cam surface 102 with there being a separate cam surface 102 for each slot 100. Connectable with the slot 102 is an arm 104. Arm 104 is mounted by bolts 106 onto an arm 108. Each bolt 106 connects with an elongated slot 110 with there being a separate slot 110 for each bolt 106. Also formed within the body of each of the arms 104 and 108 is a rectangular shaped hole 112. Mounted within hole 112 is a coil spring 114. The purpose of the spring 114 is that when the arm 104 falls within a slot 102 for the purpose of stopping rotation of the wheel 98, there is a certain amount of momentum. This momentum is absorbed by this spring 114 which permits the wheel 98 to move a slight distance in its direction of rotation shown by arrows 116 in FIG. 4. The amount of this continued movement is determined by the length of the slots 110.

What occurs is the arm 104 is picked up and in essence is carried by the wheel 98 a short distance compressing the spring 114. When the wheel 98 is completely stopped, the spring 114 will now expand back to its original position which will result in outer member 58 being oriented precisely in either a heads position or a tails position. It is to be understood that one of the slots 102 will orient the outer member 58 in the heads position while the other slot 102 will orient the outer member 58 in the tails position. The reason for the cam surface 102 associated with each slot 100 is so that the arm 104 will slide into the slot 104 gradually otherwise it might just slip over the slot 100.

The arm 104 has an at-rest position tending to press the arm 104 against the periphery of the wheel 98 and thereby will engage with a slot 100 as the wheel 98 rotates. This at-rest position is provided by a spring 118 which is mounted between a bracket 120 and an arm 122. Bracket 120 is fixedly mounted to a mounting plate 124. The mounting plate 124 is mounted across the top of the housing 12 and is fixedly mounted to both the right side panel 16 and the left side panel 18.

Figure 4:
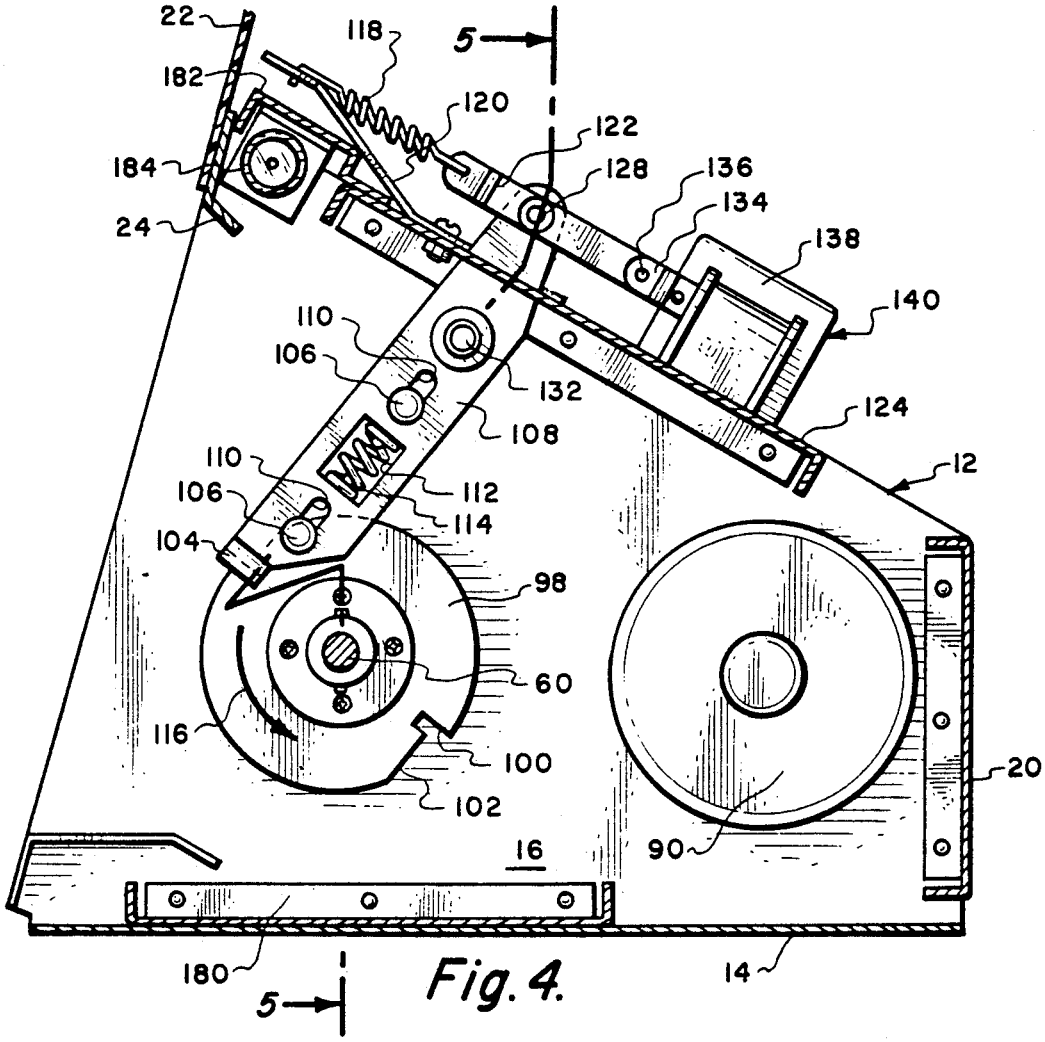
FIG. 4 is a cross-sectional view taken in the same direction as FIG. 2 but showing the stopping mechanism associated with terminating the revolving of the ring-shaped outer member of the coin representation.

A portion of the arm 108 extends through a slot 126 formed within the mounting plate 124. The arm 122 is actually bifurcated with arm 108 being located within the gap area between the spaced apart leg members of the bifurcated arm 122. A pivot connection between the arm 122 and the arm 108 is provided by means of a pin 128. Arm 108 is mounted on a sleeve 130. Sleeve 130 is located on a pivot rod 132. Arm 122 is connected to a bracket 134 by means of a pin 136. Bracket 136 is connected to the actuating member 138 of a solenoid 140. The solenoid 140 is mounted on the mounting plate 124. The solenoid 140 can be activated to retract from the position shown in FIG. 4 which will result in spring 118 moving to an extended position and arm 122 moving to the right (as shown in FIG. 4) a distance of approximately half an inch. This activation is to occur when start button 46 is pressed. This causes the arm 108 to pivot about pivot rod 132 which causes the arm 104 to move to a displaced position disengaging from a slot 100. This now permits free rotation of the outer member 58.

When one of the buttons 36, 38, 40 and 42 are pressed, the motors contained within the motor housings 90 and 92 are deactivated as well as the solenoid 140. This permits the bias of the spring 118 to then cause the arm 122 to move in a leftward direction, as shown in FIG. 4, which in turn will cause the arm 108 to pivot counterclockwise. This will result in the arm 104 coming into contact with the periphery of the wheel 98. As the wheel 98 continues to rotate it only takes a few degrees of rotation for arm 104 to engage with one of the cam surfaces 102 and then hence engage with the slot 100. Hence the outer member 58 is now randomly stopped at either the heads or tails position.

In a similar manner to the previous, there is mounted a solenoid 142 on the mounting plate 124 with this solenoid 142 having an actuating member 144. Solenoid 142 is to be activated simultaneously with solenoid 140. Connected with the actuating member 144 is a bracket 146 which is connected by means of a pin 148 to bifurcated arm 150. Arm 150 is pivotally connected by means of a pin 152 to an arm 154. Arm 154 is mounted on a sleeve 156 which is pivotally mounted on a pivot rod 158. The outer end of the arm 150 is connected to a coil spring 160 with spring 160 being connected to bracket 162. Bracket 162 is fixedly mounted on mounting plate 124. The pivot rod 158 is fixedly mounted to the side panel 16. The pivot rod 132 is fixedly mounted on the side panel 18.

It can thus be seen by activating of solenoid 142 spring 160 is extended which causes the arm 154 to pivot about pivot rod 158 so that arm 164 is disengaged from a slot 166. It is to be understood that there are two in number of the slots 166 formed within the peripheral surface of a wheel 168. Wheel 168 is essentially identical to wheel 98. Associated with each slot 166 is a cam surface 170. Wheel 168 is rotatably driven in the direction of arrow 172.

Connected between the arms 154 and 164 is a coil spring 174 which is essentially identical to and operates in the same manner as coil spring 114.

The wheel 168 is fixedly mounted on the shaft 72 by means of a pin 176. The position of the wheel 168 is to be such that when the arm 164 engages with the slot 166 that the central member 54 is located in either a heads or tails position. The exact same thing is true for wheel 98 which is mounted by pin 178 on shaft 60.

To strengthen the housing 12, mounted on the bottom panel 14 is an elongated bracing panel 180. One end of the bracing panel 180 is fixedly mounted to right side panel 16 with the opposite end of the bracing panel 180 being fixedly mounted to the left side panel 18.

Mounted between mounting plate 124 and front cross brace 24 is a light reflecting shield 182. Mounted within the interior of the shield 182 is a fluorescent light bulb 184. This light bulb 184 is connected to electrical contacts 186. Normally the light bulb 184 will be operated continuously and is for the purpose of clearly illuminating coin 52.

It is to be understood that there will be included appropriate micro switches and appropriate electrical circuitry to ensure that, when the motors contained within motor housings 90 and 96 are operated that simultaneously, that the solenoid 140 and 142 are also operated. This circuitry is also designed to be deactivated at the time one of the buttons 36, 38, 40 or 42 is pressed and at which time the solenoid 140 and 142 are deactivated along with the motors contained within each motor housing 90 and 96.

What is claimed is:

1. The game apparatus comprising: housing;

a representation of a coin, said coin having a pair of opposite parallel planar surfaces, said coin constructed of a central member and an outer member, said outer member being ring shaped forming a central opening, said inner member being located within said central opening;

first means for revolving said central member on a first axis in a first direction;

second means for revolving said outer member on a second axis in a second direction;

indicia represented on said surfaces, said indicia cooperating between said central member and said outer member to represent a heads and a tails plus a tails-heads and a head-tails;

stopping means connected to said coin, said stopping means to terminate the revolving of said central member and said outer member so as to align said planar surfaces of said coin; and both said first axis and said second axis being parallel to said planar surfaces of said coin.

2. The game apparatus as defined in claim 1 wherein: said first axis coincides with said second axis.

3. The game apparatus as defined in claim 2 wherein: the revolving of said first member being substantially simultaneous with the revolving of said second member.

4. The game apparatus as defined in claim 3 wherein: said second direction being opposite said first direction.

5. The game apparatus as defined in claim 4 wherein: said central member being revolved at a speed which is different than the speed of revolving of said outer member.

6. The game apparatus comprising: housing;

a representation of a coin, said coin having a pair of opposite parallel planar surfaces, said coin constructed of a central member and an outer member, said outer member being ring shaped forming a central opening, said inner member being located within said central opening;

first means for revolving said central member on a first axis in a first direction;

second means for revolving said outer member on a second axis in a second direction;

indicia represented on said surfaces, said indicia cooperating between said central member and said outer member to represent a heads and a tails plus a tails-heads and a head-tails;

stopping means connected to said coin, said stopping means to terminate the revolving of said central member and said outer member so as to align said planar surfaces of said coin; and selection means mounted on said housing, said selection means permitting manual selection of the position of said indicia at termination of the revolving of said central member and said outer member.

7. The game apparatus as defined in claim 6 wherein: start means mounted on said housing, said start means initiating of the revolving of said inner member and said outer member.

* * * * *